United States Patent [19]

Brantingham et al.

[11] Patent Number: 4,894,027

[45] Date of Patent: Jan. 16, 1990

[54] LAMP SOCKET TERMINAL

[75] Inventors: Duane L. Brantingham, Cortland; Patrick J. Reedy, Youngstown, both of Ohio

[73] Assignee: General Motors Corporation, Detroit, Mich.

[21] Appl. No.: 313,916

[22] Filed: Feb. 23, 1989

[51] Int. Cl.[4] ..... H01R 33/06

[52] U.S. Cl. ..... 439/699; 439/861

[58] Field of Search ..... 439/611, 619, 699, 861, 439/862

[56] References Cited

U.S. PATENT DOCUMENTS 3,017,599 1/1962 Loesch ..... 339/91
4,181,390 1/1980 Masamobu ..... 439/699
4,365,396 12/1982 Baba et al. ..... 439/699

OTHER PUBLICATIONS

Packard Electric Product Engineering Handbook, p. L-69, dated 3/87.

*Primary Examiner*—Joseph H. McGlynn
*Attorney, Agent, or Firm*—F. J. Fodale

[57] ABSTRACT

A lamp socket assembly comprises a lamp bulb having a wedge base, a lamp socket and two electrical terminals. The electrical terminals have receptacle portions which include spring contact arms which engage the contact wires of the lamp bulb and limit its insertion into the lamp socket. The receptacles also include spring detent arms which retain the wedge base in the terminals.

10 Claims, 3 Drawing Sheets

LAMP SOCKET TERMINAL

BACKGROUND OF THE INVENTION

This invention relates generally to electrical terminals and more specifically to electrical terminals for use in lamp sockets for lamp bulbs which have a wedge base.

Lamp bulbs having a wedge base have been known and used for some time. The wedge base of these lamp bulbs include a central vent tube bounded by laterally extending side wings. The lamp filament is energized by a pair of contact wires which extend out of the respective ends of the side wings and are bent over onto sides of the respective side wings which are on opposite sides of the wedge base. The other sides of the side wings have laterally extending troughs which are used to retain the lamp bulb in the lamp socket.

A common problem associated with such lamp bulbs is that the bulbs are sometimes overinserted into the lamp socket with the result that the bulb is not properly retained in the lamp socket.

Another common problem associated with such lamp bulbs is that the contact wires are often skewed or bent out of shape during handling resulting in poor or improper electrical contact when the lamp bulbs are inserted into the lamp sockets.

U.S. patent application Ser. No. 289,896, filed Dec. 27, 1988, NOW abandoned which is assigned to General Motors Corporation, the assignee of this invention, proposes a terminal which overcomes these common problems in a simple and efficient manner.

SUMMARY OF THE INVENTION

The object of this invention is to provide an improved electrical terminal for use in lamp sockets for wedge base lamp bulbs which also prevents overinsertion of the wedge base as well as accommodates skewed contact wires of the lamp bulbs in a simple and efficient manner.

A feature of the invention is that the improved electrical terminal has a stop which limits the insertion of the wedge base side wing so that the lamp bulb is properly retained in the lamp socket.

Another feature of the invention is that the stop is a relatively rigid structure which acts independently of either the spring contact arm or the spring detent arm.

Another feature of the invention is that the stop engages the contact wire against the end of the side wing to provide a redundant contact.

Yet another feature of the invention is that the stop is incorporated into the terminal so as to permit a relatively long latch finger to be formed out of the base for retaining the terminal in the lamp socket.

Still yet another feature of the invention is that the spring contact arm has a bifurcated portion which tends to center the contact wire of the lamp bulb on the side wing of the wedge base for proper engagement by the spring contact arm.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
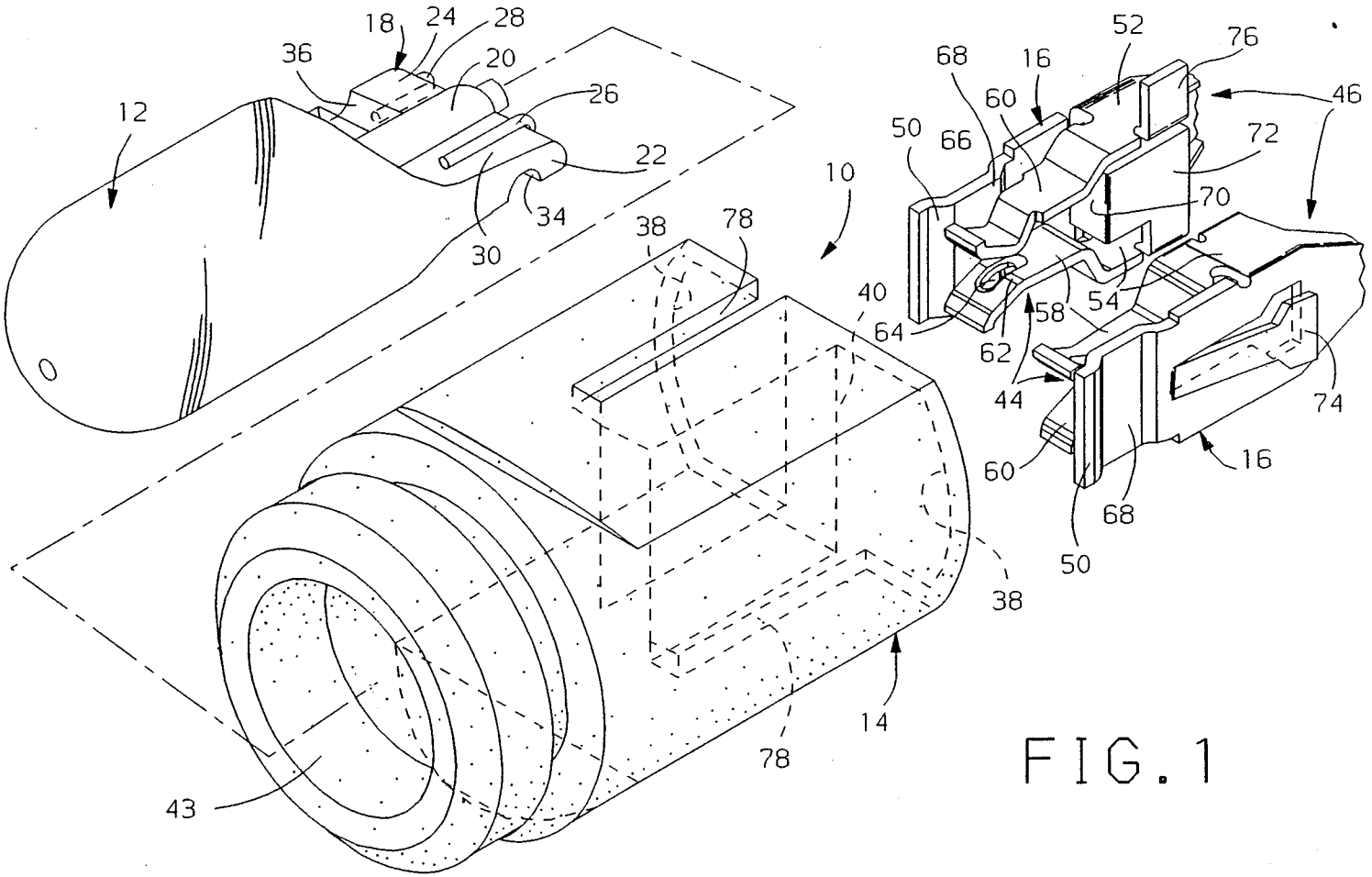
FIG. 1 is an exploded perspective view of a lamp socket assembly having electrical terminals in accordance with this invention.

Referring now to the drawing the lamp socket assembly 10 comprises a lamp bulb 12, a lamp socket 14 and two improved electrical terminals 16 in accordance with the invention.

Figure 4:
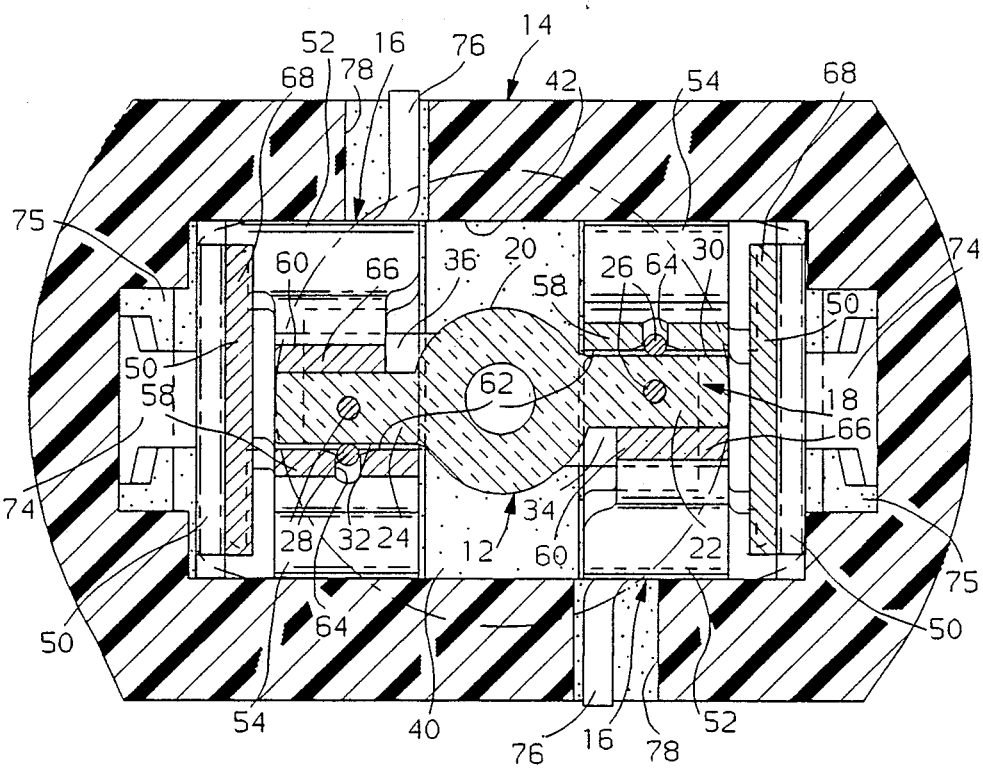
FIG. 4 is a section taken substantially along the line 4—4 of FIG. 3 looking in the direction of the arrows.

The lamp bulb 12 has a wedge base 18 which includes a central vent tube 20 bounded by laterally extending side wings 22 and 24. The filament (not shown) which is in the evacuated envelope of the lamp bulb is energized by a pair of contact wires 26 and 28 which extend out of the respective ends of the side wings 22 and 24. The emerging contact wires 26 and 28 are then bent over onto smooth sides 30 and 32 of the respective side wings which are on opposite sides of the wedge base 18 as best shown in FIG. 4. The other sides of the side wings 22 and 24, which are also on opposite sides of the wedge base 18, have laterally extending troughs 34 and 36 respectively.

Figure 3:
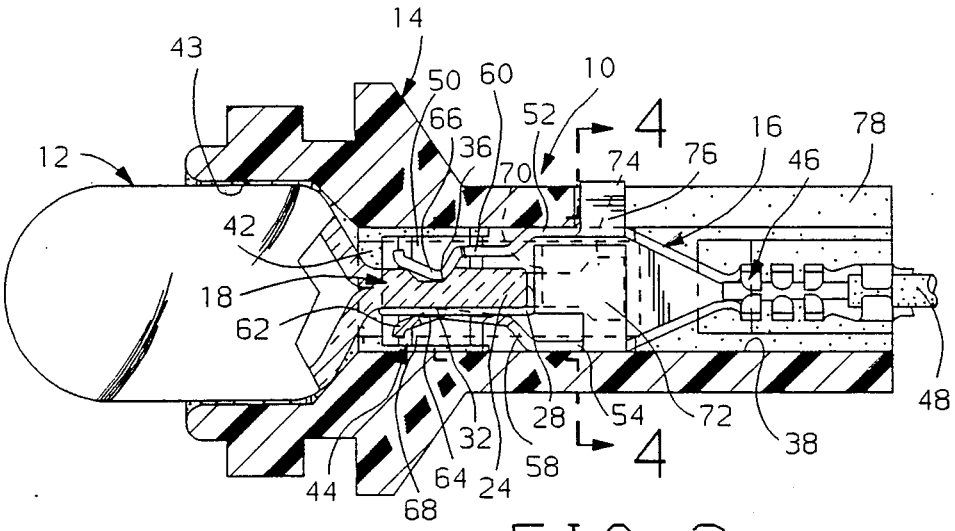
FIG. 3 is a longitudinal section of the lamp socket assembly shown in FIG. 1 after insertion of the lamp bulb.

The lamp socket 14, which is made from a thermoplastic or other suitable electrically insulative material, has a pair of terminal cavities 38 which are separated by a partition wall 40 in the conductor end of the lamp socket. The terminal cavities 38 open into a common medial cavity 42 which receives the wedge base 18 when the lamp bulb 12 is inserted in the socket 43 of the lamp socket 14 as shown in FIGS. 3 and 4.

The improved electrical terminals 16 are identical and inserted into the terminal cavities 38 upside down with respect to each other as shown in FIGS. 1 and 4. Reach improved electrical terminal 16 comprises a receptacle portion 44 and an attachment portion 46 for attaching the terminal to an electrical conductor 48 in a conventional manner such as by conventional core and insulation crimp wings.

The receptacle portion 44 has a base wall 50 and short side walls 52 and 54 which form a channel at the rearward end of the receptacle portion 44. The receptacle portion 44 further includes a spring contact arm 58 and an opposed spring detent arm 60 which are supported by the respective side walls 52 and 54.

The spring contact arm 58 is integrally connected to a forward edge of the side wall 54 in cantilever fashion and projects forwardly toward the front edge of the base wall 50. The spring contact arm 58 has a contact area 62 which is bowed inwardly toward the spring detent arm 60. The spring contact arm 58 also has a longitudinal slot 64 which extends through and bifurcates the bowed contact area 62. The upper edge of the slot 64 is coined as shown in FIGS. 1 and 4.

The spring detent arm 60 is integrally connected to a forward edge of the side wall 52 in cantilever fashion and also projects forwardly toward the front edge of the base wall 50. The spring detent arm 60 has a detent 66 which is bent inwardly toward the bowed contact area 62 of the spring contact arm 58. The detent 66 engages the laterally extending trough 36 in the upper side of the side wing 24, as viewed in FIGS. 1 and 3, when the side wing 24 is inserted into the space between the opposed spring contact arm 58 and spring detent arm 60 as shown in FIGS. 3 and 4.

The base wall 50 has a mid portion 68 which is offset in the lateral direction toward the spring contact arm 58 and the spring detent arm 60 in the vicinity of the contact area 62 and detent 66. This offset mid portion 68 forms a further redundant contact as explained below.

The receptacle portion 44 also includes a stop 70 which is an inwardly bent end of a tab 72 which positions the stop 70 between the rearward ends of the spring contact arm 58 and the spring detent arm 60. The tab 72 is integrally connected to a side edge of the side wall 54 and extends toward the the side wall 52 in a fashion which is generally parallel to the base wall 50.

Figure 2:
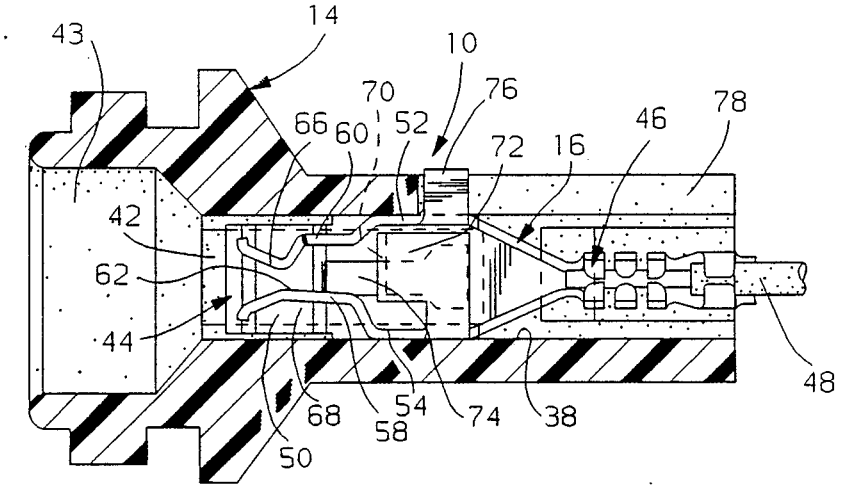
FIG. 2 is a longitudinal section of the lamp socket assembly shown in FIG. 1 prior to insertion of the lamp bulb.

A latch tang 74 is cut and bent from the portion of the base wall 50 rearwardly of the laterally offset mid portion 68 as shown in FIG. 1. The latch tang 74, which slants outwardly of the receptacle 44 in the rearward direction, retains the terminal 16 in the lamp socket 14 by engaging a cooperating shoulder 75 in the terminal cavity 38. The use of tab 76 to position the stop 70 permits incorporation of a relatively long latch tang 74 which extends rearwardly past the stop 70 as is evident from FIGS. 1 and 2.

The receptacle portion 44 includes a second tab 76 which is integrally connected to the a side edge of the side wall 52 and which extends outwardly of the receptacle portion 44. The tab 76 is received in one of a plurality of slots 78 of the lamp socket 14 to insure that each terminal 16 is correctly oriented and positioned in the lamp socket 14.

When the side wing 24 is inserted into the terminal 16 which is housed in the lamp socket 14, the bifurcated contact area 64 of the spring contact arm 58 engages the end of the side wing 24 on either side of the contact wire 28 where the contact wire 28 emerges from the end of the side wing 24. The contact wire 28 tends to be precisely located at its emerging point even if the rest of the contact wire 28 is badly skewed during handling. Consequently, the prospect of the contact wire 28 entering the longitudinal slot 64 are maximized. As the contact area 64 slides onto the smooth surface 30 of the side wing 24, the contact wire 28 then rides in the longitudinal slot 64 which centers the contact wire 28 on the smooth surface 30 by a camming action for proper engagement by the spring contact arm 58.

When the side wing 24 is fully inserted, the end of the side wing 24 engages the stop 70 which prevents overinsertion and properly positions the lateral trough 36 for engagement by the detent 66. The stop 70 also engages the contact wire 28 against the end of the side wing 24 to provide a redundant contact as shown in FIG. 3.

As noted above, the laterally offset portion 68 of the base wall 50 form a further redundant contact. This is for the case of badly skewed contact wires which cannot be properly located on the smooth surface 30 by the bifurcated contact area 64. In this instance the offset portion 68 engages the contact wire 28 against the side of the side wing 24.

As indicated above the second terminal 16 is identical and used in an upside down relation ship as shown in FIG. 4. The second terminal 16 cooperates with the side wing 22 in the same way to establish electrical contact with the contact wire 26.

Figure 5:
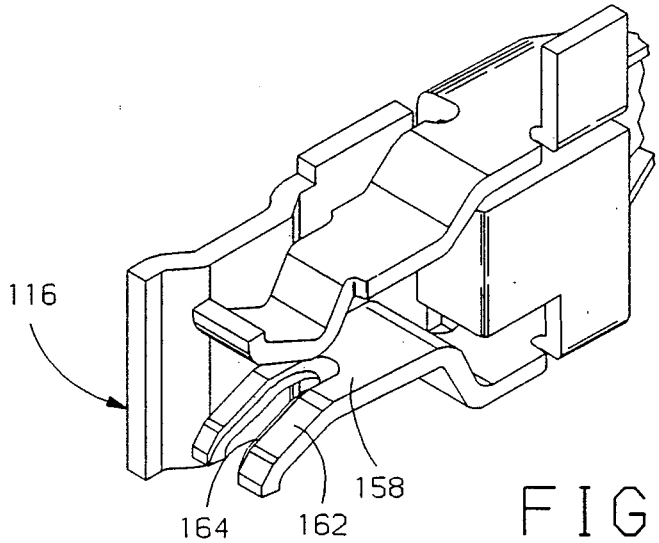
FIG. 5 is a perspective view of an alternate terminal.

FIG. 5 shows an alternative terminal 116. This terminal is identical to terminals 16 except that the bowed contact area 162 of the spring contact arm 158 is bifurcated by an open ended longitudinal slot 164 rather than the closed longitudinal slot 64 of terminal 16.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion and an attachment portion for attaching the terminal to an electrical conductor;

the receptacle portion having a base wall and a pair of side walls forming a channel which is spaced rearwardly of a forward end of the base wall, a spring contact arm which is integrally connected to a forward edge of one side wall of the channel in cantilever fashion and projects forwardly to engage a contact wire extending out of an end of one side wing of the wedge base, a spring detent arm which is integrally connected to the forward edge of the other side wall of the channel in cantilever fashion and projects forwardly to engage a trough in the one side wing of the wedge base, and a stop tab which is connected to one of the side walls of the channel and which is disposed between the spring contact arm and the spring detent arm to engage the end of the one side wing when it is inserted into a space between the spring contact arm and the spring detent arm so as to properly locate the trough for engagement by the spring detent arm.

2. The terminal as defined in claim 1 wherein the stop tab is an inwardly bent end of a side tab which is integrally connected to a side edge of one of the side walls which form the channel which supports the spring contact arm and the spring detent arm.

3. The terminal as defined in claim 2 wherein the stop tab engages the contact wire against the end of the one side wing and the terminal includes a latch tang which is cut and bent from the base wall, the latch tang slanting outwardly of the receptacle portion in the rearward direction and extending past the stop in the rearward direction.

4. The terminal as defined in claim 1 wherein the spring contact arm has a contact area which is bifurcated by a longitudinal slot for centering the contact wire on the first side of the side wing when the side wing is inserted into the space between the spring contact arm and the spring detent arm.

5. The terminal as defined in claim 4 wherein the contact area of the spring contact arm is bowed inwardly toward the spring detent arm and the longitudinal slot extends through the bowed contact area so that bifurcated contact area engages the end of the side wing when the side wing is inserted into the space between the spring contact arm and the spring detent arm.

6. A terminal for use in a lamp socket for a lamp bulb having a wedge base which includes a central vent tube bounded by laterally extending side wings, a pair of contact wires extending out of the respective ends of the side wings and bent over onto first sides of the respective side wings which are on opposite sides of the wedge base, and a pair of laterally extending troughs in second sides of the respective side wings which are on opposite sides of the wedge base, the terminal comprising:

a receptacle portion and an attachment portion for attaching the terminal to an electrical conductor;

the receptacle portion having a base wall and a pair of side walls forming a channel which is spaced rearwardly of a forward end of the base wall, a spring contact arm which is integrally connected to a forward edge of one side wall of the channel in cantilever fashion and projects forwardly to engage a contact wire extending out of the end of the one side wing of the wedge base, a spring detent arm integrally connected to the forward edge of the other side wall of the channel in cantilever fashion and projecting forwardly to engage a trough in the one side wing of the wedge base, and the spring contact arm having a contact area which is bifurcated by a longitudinal slot for centering the contact wire on the first side of the side wing when the side wing is inserted into a space between the spring contact arm and the spring detent arm.

7. The terminal as defined in claim 6 wherein the contact area of the spring contact arm is bowed inwardly toward the spring detent arm and the longitudinal slot extends through the bowed contact area so that bifurcated contact area engages the end of the side wing when the side wing is inserted into the space between the spring contact arm and the spring detent arm.

8. The terminal as defined in claim 6 wherein a stop tab is connected to one of the side walls of the channel and is disposed between the spring contact arm and the spring detent arm to engage the end of the side wing when it is inserted into the space between the spring contact arm and the spring detent arm so as to properly locate the trough for engagement by the detent of the spring detent arm.

9. The terminal as defined in claim 8 wherein the stop tab is an inwardly bent end of a side tab which is integrally connected to a side edge of one of the side walls which form the channel which supports the spring contact arm and the spring detent arm.

10. The terminal as defined in claim 9 wherein the terminal includes a latch tang which is cut and bent from the base wall, the latch tang slanting outwardly of the receptacle portion in the rearward direction and extending past the stop in the rearward direction.

* * * * *